US007686189B2

(12) United States Patent
Althoff et al.

(10) Patent No.: US 7,686,189 B2
(45) Date of Patent: Mar. 30, 2010

(54) POCKET SIZED FLUID DISPENSER

(75) Inventors: Charles Peter Althoff, Cleveland Hts., OH (US); Jason Tilk, Cleveland Hts., OH (US); John William Nottingham, Bratenahl, OH (US); John Richard Nottingham, Bratenahl, OH (US); John Wilford Spirk, Jr., Gates Mills, OH (US); Jay Tapper, Beachwood, NJ (US); Ian Stuart Midgley, Leeds (GB); Dean Michael Limb, Wakefield (GB)

(73) Assignee: Conopco, Inc., Englewood Cliffs, NJ (US)

( * ) Notice: Subject to any disclaimer, the term of this patent is extended or adjusted under 35 U.S.C. 154(b) by 525 days.

(21) Appl. No.: 11/625,992

(22) Filed: Jan. 23, 2007

(65) Prior Publication Data

US 2008/0173675 A1 Jul. 24, 2008

(51) Int. Cl.
*B67B 5/00* (2006.01)

(52) U.S. Cl. ..... 222/153.11; 222/402.11

(58) Field of Classification Search ..... 222/153.11, 222/153.13, 402.11, 153.01
See application file for complete search history.

(56) References Cited

U.S. PATENT DOCUMENTS

| | | | | | |
|---|---|---|---|---|---|
| 3,426,948 | A | | 2/1969 | Stirling | 222/402.11 |
| 3,484,023 | A | | 12/1969 | Meshberg | 222/402.11 |
| 3,782,605 | A | * | 1/1974 | Messenger | 222/153.11 |
| 4,220,263 | A | | 9/1980 | Caruso | 222/183 |
| 4,277,004 | A | | 7/1981 | Barlics | 222/402.14 |
| 4,454,966 | A | | 6/1984 | Hicks | 222/153 |
| 4,477,005 | A | | 10/1984 | Martinez | 224/218 |
| 5,070,611 | A | | 12/1991 | Derin et al. | 30/41 |
| 5,088,121 | A | * | 2/1992 | Wallace | 222/175 |
| 5,411,185 | A | | 5/1995 | Drobish | 222/402.17 |
| 5,649,645 | A | | 7/1997 | Demarest et al. | 222/153.07 |
| 5,839,624 | A | * | 11/1998 | Parsons | 222/402.19 |
| 6,523,722 | B1 | | 2/2003 | Clark et al. | 222/153.14 |
| 6,877,643 | B2 | * | 4/2005 | Schneider | 222/402.11 |
| D508,208 | S | | 8/2005 | Ozaki et al. | D9/688 |
| D541,170 | S | | 4/2007 | Bloc | D9/692 |
| 2004/0143977 | A1 | | 7/2004 | Selek | 30/526 |

(Continued)

FOREIGN PATENT DOCUMENTS

DE 20 2006 010 781 11/2006

(Continued)

OTHER PUBLICATIONS

Pictures of Aerosol Deodorant Body Sprays (0.75 oz., Tag spray (dispenser and insert), (0.75 oz.) Old Spice Red Zone spray, and 1 oz. Axe Spray).

(Continued)

*Primary Examiner*—Kevin P Shaver
*Assistant Examiner*—Jonathan Wood
(74) *Attorney, Agent, or Firm*—Fay Sharpe LLP

(57) ABSTRACT

A liquid cosmetic product dispenser that can allow a person to quickly and unobtrusively apply liquid cosmetic product includes a palm sized dispenser and the liquid cosmetic product is disposed in the dispenser under pressure that is greater than atmospheric pressure. The dispenser includes a movable actuator button for controlling dispensing of the liquid cosmetic product from the dispenser and a locking mechanism for locking the actuator button.

22 Claims, 6 Drawing Sheets

U.S. PATENT DOCUMENTS

| | | | | |
|---|---|---|---|---|
| 2005/0017027 | A1 | 1/2005 | Yerby et al. | 222/402.13 |
| 2006/0113327 | A1 | 6/2006 | Walters et al. | 222/153.11 |
| 2007/0241134 | A1 | 10/2007 | Gurrisi et al. | 222/153.11 |

FOREIGN PATENT DOCUMENTS

| | | | |
|---|---|---|---|
| FR | 2 569 581 | | 3/1986 |
| FR | 2569581 | A1 * | 3/1986 |
| GB | 2 087 840 | | 6/1982 |
| JP | 50-121817 | | 9/1975 |
| JP | 2001 163379 | | 6/2001 |
| JP | 2004 123136 | | 4/2004 |
| WO | 2007/017039 | | 2/2007 |

OTHER PUBLICATIONS

Co-pending Application: Applicant: Althoff et al., U.S. Appl. No. 29/276,342, filed Jan. 23, 2007.

Co-pending Application: Applicant: Althoff et al., U.S. Appl. No. 29/276,343, filed Jan. 23, 2007.

Picture of non-aerosol pump spray; Nivea Deo Compact (20ml).

PCT International Search Report in PCT application PCT/EP2008/050569.

Derwent Abstract of FR 2 569 581—published Mar. 7, 1986.

PCT International Search Report in PCT application PCT/EP2008/050568.

* cited by examiner

POCKET SIZED FLUID DISPENSER

BACKGROUND

Body odor, as well as other unpleasant odors from cigarette smoke, food, etc., can be embarrassing in certain situations. For young people, especially adolescent males, these unpleasant odors can be very embarrassing. A liquid cosmetic product, such as perfume or cologne, can be applied to overcome and/or eliminate these unpleasant odors. Aerosol dispensers are particularly useful to dispense liquid cosmetic products, e.g. antiperspirant, deodorant and fragrance products, quickly and evenly over a person's body.

Oftentimes these unpleasant odors can arise at a time or a location where one does not typically have access to a private location, e.g. a washroom, where he can dispense a fragrance, deodorant or antiperspirant. Moreover, known aerosol dispensers used to dispense liquid cosmetic products include large cans that are not easily carried or concealed thus making difficult unobtrusive application of the product in public.

SUMMARY

A dispenser that can allow a person to quickly and unobtrusively apply liquid cosmetic product includes a palm sized dispenser and the liquid cosmetic product is disposed in the dispenser under pressure that is greater than atmospheric pressure. The dispenser includes a movable actuator button for controlling dispensing of the liquid cosmetic product from the dispenser and a locking mechanism for locking the actuator button.

DETAILED DESCRIPTION

Figure 1:
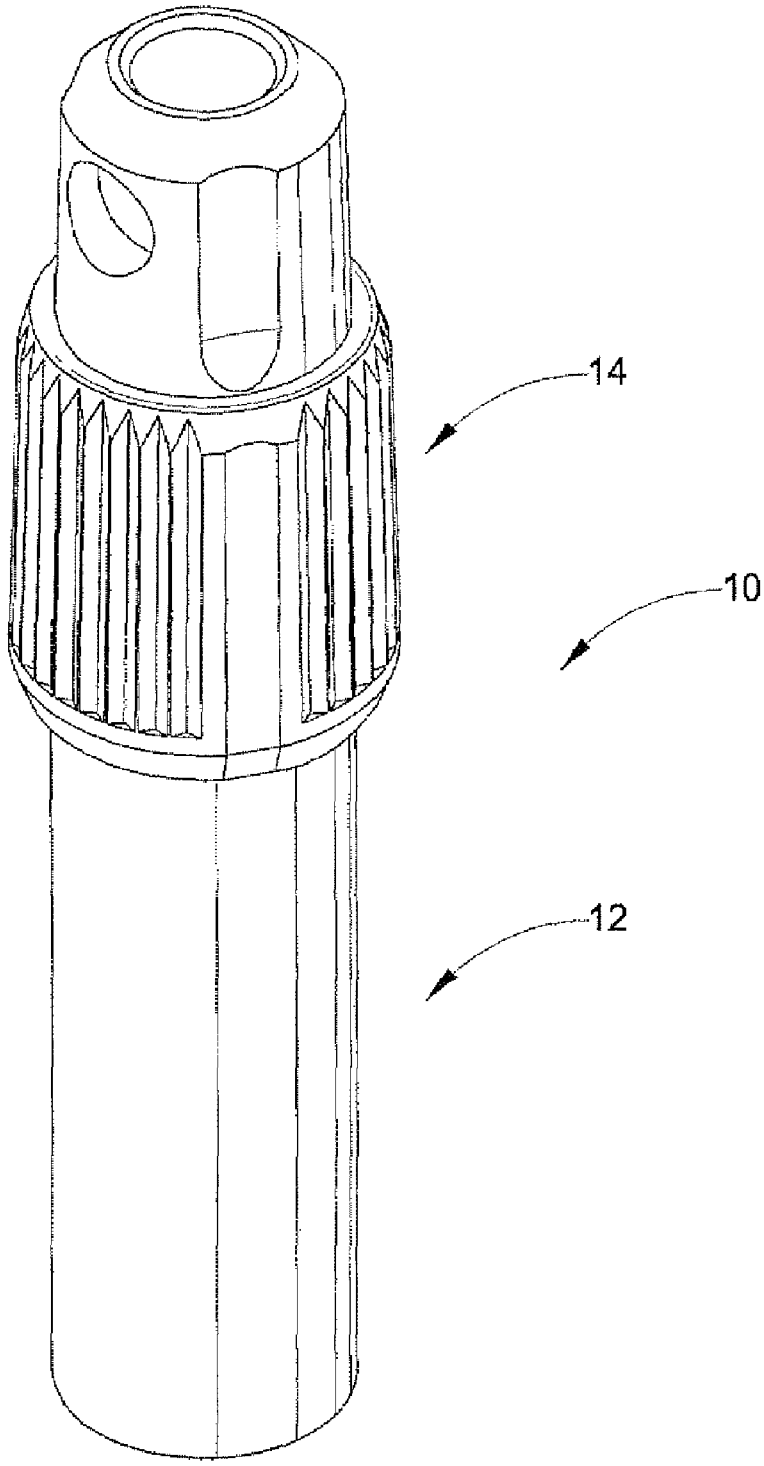
FIG. 1 is a perspective view of a liquid cosmetic product dispenser.

With reference to the embodiment depicted in FIG. 1, a dispenser 10 contains a liquid cosmetic product, which can include hair spray, body spray, deodorant, antiperspirant and fragrances such as perfume and cologne. The dispenser 10 contains the liquid cosmetic composition under pressure, i.e. a pressure that is greater than atmospheric pressure, similar to a known aerosol container so that the liquid cosmetic product can be quickly dispensed from the dispenser.

Figure 2:
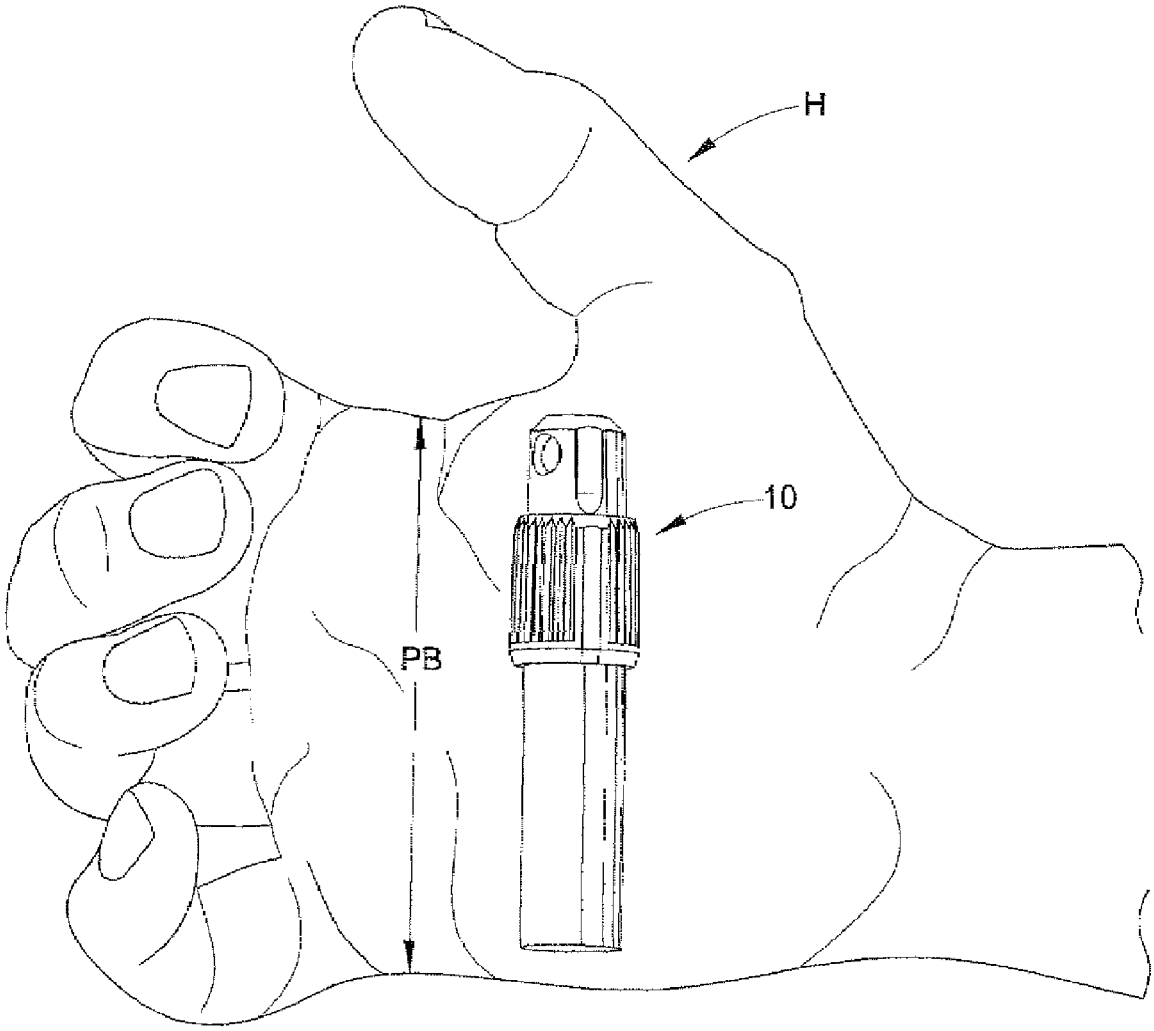
FIG. 2 is a perspective view of the liquid cosmetic product dispenser placed in the palm of a typical teenage boy's hand.

As seen in FIG. 2, the dispenser 10 can be appropriately shaped and sized so it is discretely concealed in a person's palm and can be concealed or substantially completely concealed in a closed fist. Because of the small size of the dispenser 10, it also fits conveniently into a clothing pocket. In one embodiment the dispenser has a diameter up to about 2.5 cm, more particularly, from about 1 cm to about 2.5 cm, and a height less than about 9 cm, more particularly, from about 7 cm to about 8 cm. In another embodiment the dispenser has a diameter of from about 1.5 cm to about 2 cm, and a height of from about 7 cm to about 8 cm. The hand H shown in FIG. 2 is meant to depict a typical teenage boy's hand having a palm breadth PB of about 7 cm to about 9 cm and a first finger length of about 10 cm to about 14 cm. The dispenser 10 is discretely concealed in the person's palm and can be dispensed quickly to cover up or eliminate embarrassing odors. For example, the first finger can be moved to allow the liquid cosmetic product to exit the dispenser and the thumb can be used to operate the dispenser.

With reference back to FIG. 1, the dispenser 10 includes a container 12 and an actuator assembly 14. The container and the actuator assembly are attached to one another and form a single unit that is disposed or recycled once the liquid cosmetic product has been dispensed from the dispenser.

The container 12 includes a chamber that holds the liquid cosmetic product that is to be dispensed. In the depicted embodiment, the container 12 has an internal free volume of less than about 60 mL. In one embodiment, the container has an internal free volume of from about 5 mL to about 40 mL. In another embodiment, the container has an internal free volume of from about 5 mL to about 20 mL. In another embodiment the container has an internal free volume of from about 6 mL to about 15 mL, more particularly, from about 6 mL and about 10 mL. In another embodiment, the container has an internal free volume of about 8.5 mL. The container is cylindrical in shape, similar to a conventional aerosol can, but can take other configurations without departing from the scope of the invention. In the depicted embodiment, the container has a diameter of up to about about 20 mm. In another embodiment the container has a diameter of from about 10 to about 20 mm, more particularly from about 10 to about 15 mm. In yet another embodiment, the diameter is about 15 mm. The container 12 connects to and is selectively opened and closed by the actuator assembly 14. The container is cylindrical with an open top and in the depicted embodiment is made from aluminum. Other materials can be used. Where the liquid cosmetic product is to be held under pressure, the other materials should be able to withstand the pressure at which the liquid cosmetic product will be held.

Figure 3:
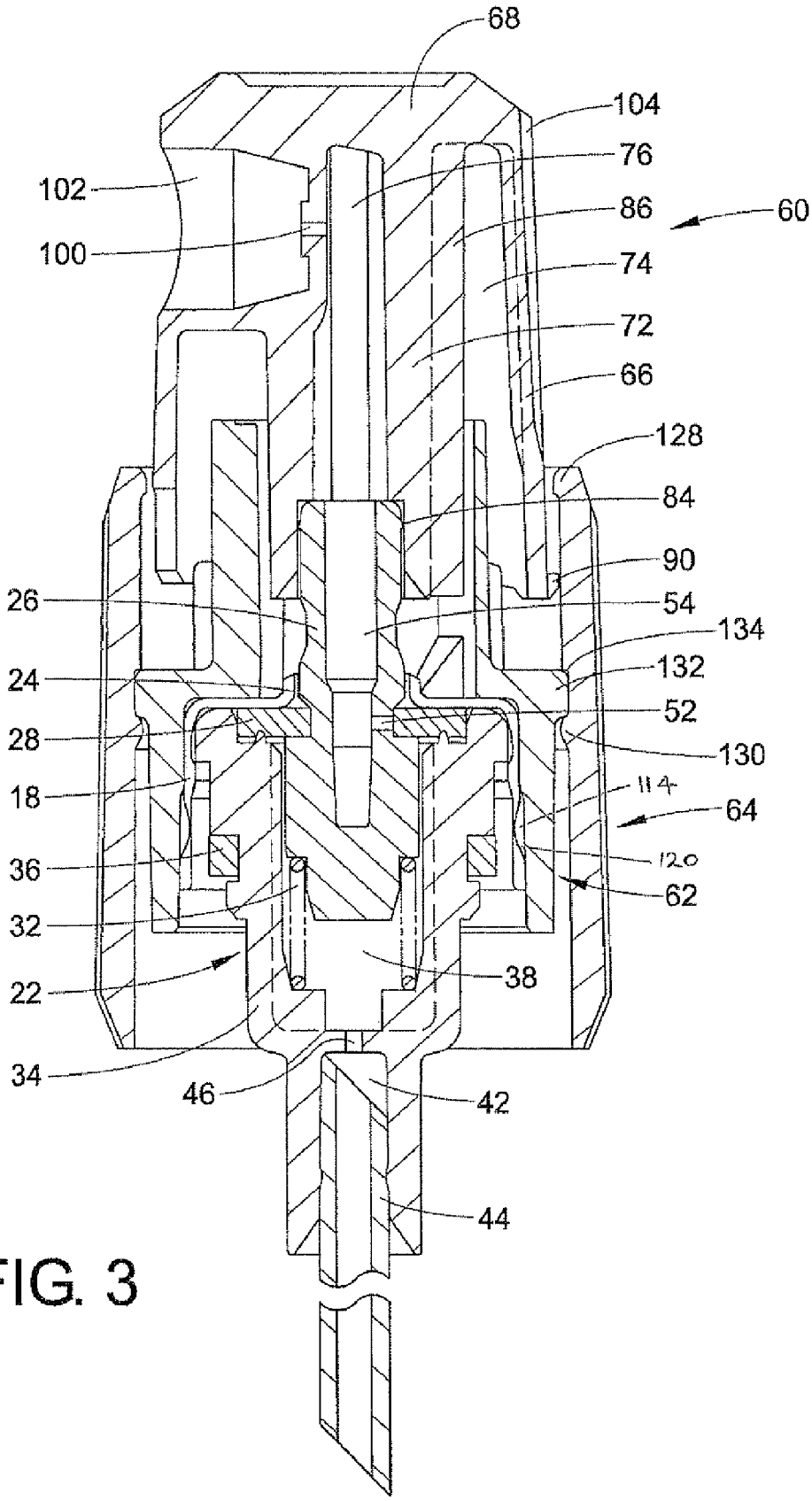
FIG. 3 is a cross-sectional view of an upper portion of the dispenser depicted in FIG. 1.
Figure 4:
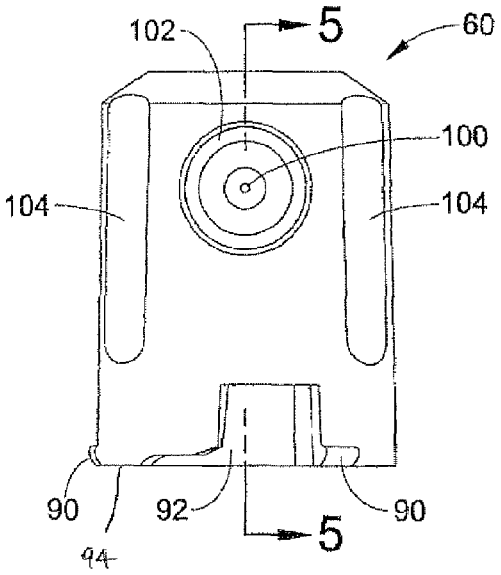
FIG. 4 is a front elevation view of the actuator button for the dispenser of FIG. 1.
Figure 6:
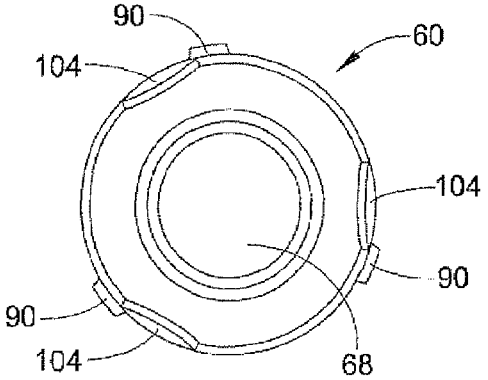
FIG. 6 is a top plan view of the actuator button depicted in FIG. 4.
Figure 7:
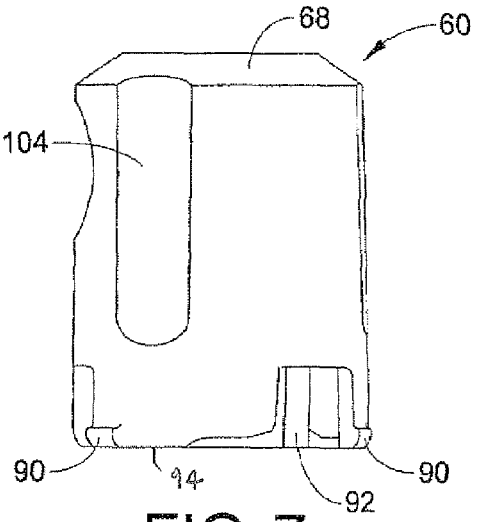
FIG. 7 is a side elevation view of the actuator button depicted in FIG. 4.
Figure 5:
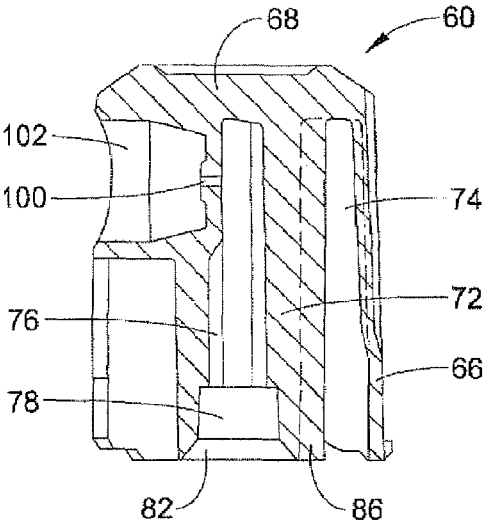
FIG. 5 is a cross-sectional view taken along line 5-5 of FIG. 4.
Figure 8:
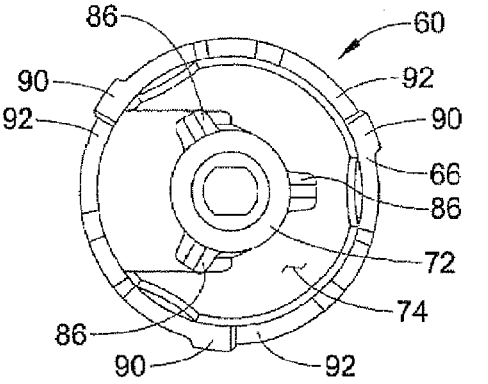
FIG. 8 is a bottom plan view of the actuator button depicted in FIG. 4.

With reference to FIG. 3, a valve cup 18 that forms part of a valve assembly 22 connects to and covers the container (the container 12 is not shown in FIG. 3). The valve cup 18 fits onto the container and is also made of aluminum. The valve cup 18 has a diameter at its uppermost end that, in one embodiment, is less than about 20 mm and preferably less than about 15 mm. The valve cup 18 crimps on to the container 12 via an external crimping action that reduces the diameter of the container and the valve cup at the crimped portion to a diameter that, in one embodiment, is from about 10 to about 12 mm, more particularly, from about 11.2 mm to about 11.7 mm. In one embodiment, the crimp depth is from about 4 to about 6 mm, more particularly from about 4.4 to about 5.3 mm. The valve cup 18 includes an opening 24 through which a valve stem 26 of the valve assembly extends. The valve assembly 22 selectively opens and closes to provide selective dispensing of-the liquid cosmetic product stored in the container.

With continued reference to FIG. 3, the valve assembly 22 includes a valve stem 26 that extends through the opening 24 in the valve cup 18. An annular seal 28 surrounds the valve stem 26. A biasing member, such as a spring 32, biases the valve stem 26 upwardly (as per the orientation depicted in FIG. 3) towards a closed position which is shown in FIG. 3. The biasing member 32 is seated in and acts against a valve seat 34. The annular seal 28 is pressed against an upper inner surface of the cap 18 by the valve seat 34. A second, lower annular seal 36 surrounds the valve seat 34 and abuts an inner cylindrical surface of the container 12 (not depicted in FIG. 3). The container 12 is sandwiched between the valve cup 18 and the valve seat 34 so that these components are fixed in relation to one another. The valve seat 34 defines a valve chamber 38 that receives the spring 32 and a lower portion of the valve stem 26. The valve seat 34 also defines a dip tube chamber 42 that snuggly receives a dip tube 44 that extends into the container 12 (FIG. 1) holding the liquid cosmetic product. The dip tube 42 is in communication with the valve chamber 38 via a passage 46.

To dispense product from the container 16, the valve stem 26 is moved towards the valve seat 34 and acts against the biasing force of the spring 32 to open the valve assembly 22. A radial opening 52 formed in the valve stem 26 is blocked by the annular seal 28 when the valve stem is biased to the closed position as shown in FIG. 3. When the valve stem 26 is moved downwardly with respect to the annular seal 28, then the radial passage 52, which is in communication with an axial passage 54, also communicates with the valve chamber 38, which is under pressure, and the valve chamber is in communication with the dip tube 42 via the passage 46.

The actuator assembly 14 includes an actuator button 60 that selectively moves the valve stem 26 to dispense the liquid cosmetic product. The actuator assembly 14 connects to the container 12 and is "capless" for quick actuation. Because the actuator assembly is capless, i.e. a cap is not removed from the dispenser prior to dispensing product, a locking mechanism is provided to inhibit accidental dispensing of the liquid cosmetic product from the dispenser. The actuator assembly 14 in the depicted embodiment includes the actuator button 60, an intermediate ring 62 and a locking ring 64. Because of the small size the user of the dispenser can operate, lock and unlock the dispenser using only one hand if desired. In the depicted embodiment, the locking mechanism is located with respect to the actuator to facilitate one handed operation.

The actuator button 60 is movable to move the valve stem 26 against the biasing force of the spring 32. The actuator button 60 in the depicted embodiment is generally cylindrical having a closed end and an open end. In the depicted embodiment the actuator button is made from a molded plastic, but other materials and methods of manufacture can be used. With reference to FIGS. 4-8, the actuator button 60 includes a generally cylindrical outer wall 66 depending from an upper platform 68 and a stem socket 72 that is radially spaced from the outer wall and depends from the upper platform 68. An annular gap 74 is disposed between the outer wall 66 and the stem socket 725 and as seen in FIG. 3 a portion of the intermediate ring 62 resides in this gap 74 when the actuator assembly 14 is finally assembled and attached to the container 12.

As most clearly seen in FIG. 3, the actuator button 60 directly connects to the valve stem 26. To make this connection, a passage 76 is formed in the stem socket 72. With reference back to FIG. 5, the passage includes a lower counterbore 78 that receives the valve stem 26 and a chamfer 82 to facilitate alignment and connection of the actuator button 60 to the valve stem 26. The valve stem 26 includes an annular protuberance 84 that radially extends from the outer cylindrical surface of the valve stem 26 and engages with the inner cylindrical surface of the couterbore 78. The outer diameter of the valve stem 26 at the protuberance 84 is slightly larger than the diameter of the counterbore 78 to provide a friction fit between the actuator button 60 and the valve stem 26 so that removal of the actuator button 60 from the valve stem 26 is difficult. In making the fit, the protuberance 84 and/or the inner surface of the counterbore 78 can deform. Alternatively, the valve stem 26 can be formed with an interlock feature to facilitate a secure attachment and preclude easy removal of the actuator button from the valve stem.

In the depicted embodiment, the actuator button 60 does not easily rotate with respect to the container 12. The actuator button 60 includes a plurality of splines 86 (FIG. 8) that extend from the stem socket 72 to provide the stem socket with a non-circular configuration to control the rotational movement of the actuator button 60 with respect to the intermediate ring 62 and thus the container 12 in a manner that will be described in more detail below. As most clearly seen in FIG. 8, the splines 86 are angularly spaced 120 degrees from one another around the inner stem socket 72. The splines 86 cooperate with the intermediate ring 62 in a manner that will be described in more detail below.

The actuator button 60 also cooperates with the locking ring 64. The actuator button 60 includes external tabs 90 formed on a lower (per the orientation of FIG. 4) end that extend radially outwardly from the generally cylindrical outer wall 66. As most clearly seen in FIG. 8, the external tabs 90 are angularly displaced 120 degrees apart from one another about the circumference of the outer annular wall 66. The actuator button 60 also includes a plurality of cutouts 92 formed in and extending upwardly from a lowermost edge 94 of the annular wall 66. In the depicted embodiment, three cutouts 92 spaced 120 degrees apart from one another are formed in the actuator button 60. Each cutout 92 terminates adjacent a respective external tab 90.

The actuator button 60 also includes a cosmetic liquid product outlet 100 that is in communication with the internal passage 76. In the embodiment where the dispenser is capless, the outlet 100 is always in communication with ambient. The outlet passage 100 connects the internal passage 76 to an outlet cavity 102 that is formed in the actuator button. The depth and diameter of the cavity 102 is a function of the pressure at which the cosmetic liquid product is held in the container as well as function of the diameter of the outlet 100. The cosmetic liquid product emanates from the fluid outlet 100 and disperses in a radial fashion outwardly from the fluid outlet. The cavity 102 is dimensional so that little, if any, liquid cosmetic product contacts the cavity wall when being dispensed from the dispenser. Lastly, the actuator button 60 includes a plurality of longitudinal recesses 104 that act as a type of an alignment mechanism for the locking mechanism, which will be described in more detail below.

Figure 10:
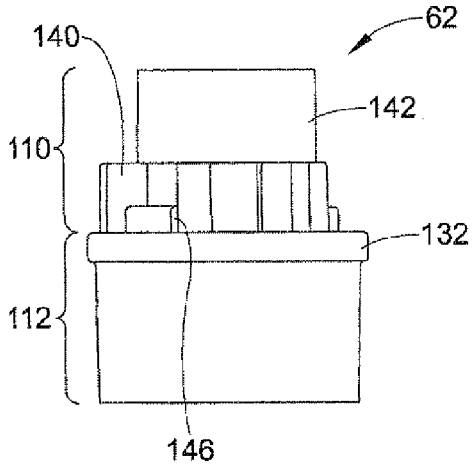
FIG. 10 is a side elevation view of the intermediate ring depicted in FIG. 9.

With reference to FIG. 3, the intermediate ring 62 cooperates with the actuator button 60 and the locking ring 64. With reference to FIG. 10, the intermediate ring 62 in the depicted embodiment is a molded plastic part having an upper section 110 and a lower section 112 (as per the orientation depicted in FIG. 10). The upper section 110 and a lower section 112 are both generally cylindrical.

The intermediate ring 62 very snugly fits to the container 12 so that axial movement (with respect to a central axis of the container) is very difficult as well as rotational movement about the axis. To provide this very snug fit the lower section 112 of the intermediate ring 62 includes an inwardly protruding annular protuberance 114 that fits into an axially inwardly directed annular channel or indentation 120 (FIG. 3) formed via the external crimp that is formed in the container 12 and the valve cup 18. The fit between the intermediate ring 62 and the container 12 is such that a torque of at least about 30 N-cm is required to rotate the intermediate ring with respect to the container and a removal force of at least about 100 N is required to remove the intermediate ring from the container once it is attached to the container. This allows the intermediate ring 62 to operate as a relatively stationary component, e.g. in comparison to the locking ring 64, of the dispenser and other components, i.e. the actuator button 60 and the locking ring 64, can move with respect to the intermediate ring.

Figure 9:
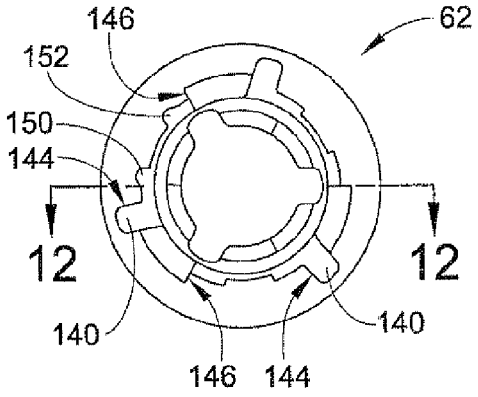
FIG. 9 is a top plan view of an intermediate ring for the dispenser of FIG. 1.
Figure 11:
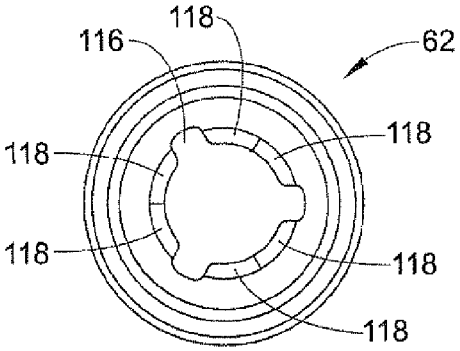
FIG. 11 is a bottom plan view of the intermediate ring depicted in FIG. 9.
Figure 13:
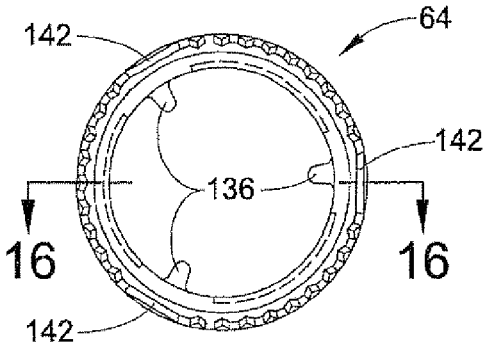
FIG. 13 is a top plan view of a locking ring for the dispenser shown in FIG. 1.
Figure 14:
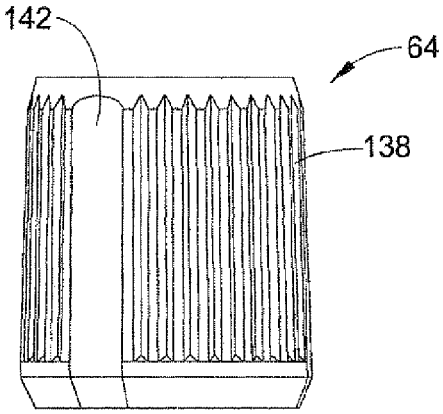
FIG. 14 is a side elevation view of the locking ring shown in FIG. 13.

The intermediate ring 62 also cooperates with the actuator button 60 to inhibit rotational movement of the actuator button 60 about the central axis of the container With reference to FIGS. 9 and 11, tracks 116 are formed in the upper section 110 of the intermediate ring 62. The tracks 116 are angularly spaced 120 degrees apart from one another similar to the splines 86 (FIG. 8) formed in the actuator button 60. Ramps 118 formed on an inner wall of the upper section 110 are sloped toward the tracks 116 for the splines 86 (FIG. 8) of the actuator button 60. The ramps 118 provide an alignment feature for the insertion of the actuator button into the intermediate ring during assembly of the dispensers.

With reference to FIGS. 13-16, the locking ring 64 is a generally tapered annular molded piece of plastic. The locking ring 64 includes an upper inwardly extending annular protrusion 128 that the lower external tabs 90 of the actuator button 60 slide over when the locking ring is placed over the button (see FIG. 3).

Figure 12:
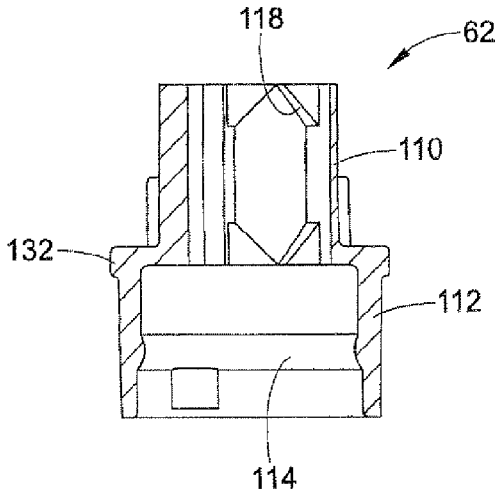
FIG. 12 is a cross-sectional view taken along line 12-12 of FIG. 9.
Figure 16:
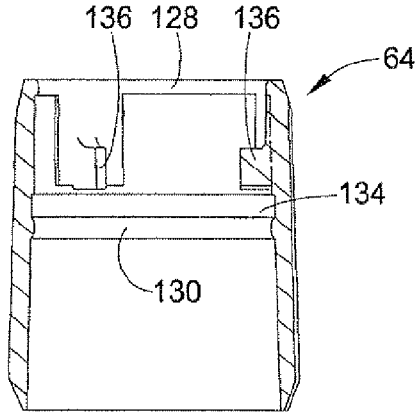
FIG. 16 is a cross-sectional view of the locking ring taken along line 16-16 of FIG. 13.
Figure 15:
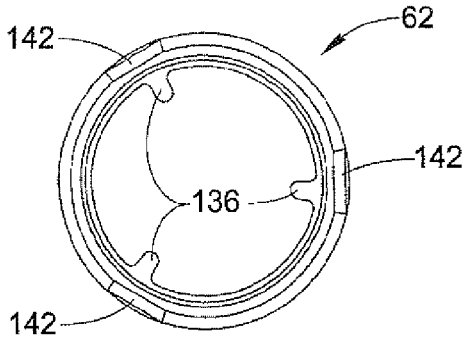
FIG. 15 is a bottom plan view of the locking ring shown in FIG. 13.

The locking ring 64 attaches to the intermediate ring 62 via a press fit. More particularly, an inwardly protruding annular ridge 130 is pressed over an outwardly protruding annular ridge 132 (FIGS. 10 and 12) formed at an upper end of the lower section 112 of the intermediate ring 62. With reference to FIGS. 3 and 16, a channel 134 is formed in the locking ring 64 above the annular ridge 130 that receives the outwardly extending annular ridge 132 (FIG. 12) of the intermediate ring. The connection between the locking ring 64 and the intermediate ring 62 precludes axial movement (the axis being defined as the central axis of the container 12) while allowing rotational movement about the axis of the locking ring with respect to the intermediate ring. Desirably, the locking ring 64 can rotate with respect to the intermediate ring 62 upon the application of a torque of from about 2 N-cm to about 6 N-cm, which is much less than the torque required to rotate the intermediate ring 62 about the container 12. The upper torque limit, i.e. about 6 N-cm, is determined to provide an ease of use. If the torque is too high, then it is difficult for an operator to rotate the locking ring 64. The lower torque limit is selected to inhibit accidental rotation, for example when the dispenser is located in one's clothing pocket. If the torque required to rotate the locking ring 64 is too low, the locking ring may have a tendency to rotate inadvertently.

A plurality of inwardly protruding tabs 136 are provided on the locking ring 64 and cooperate with the actuator button 60 to selectively limit the axial movement of the actuator button 60 with respect to the locking ring and more particularly with respect to the container to control opening and closing the valve assembly 22. With reference back to FIG. 7, the tabs 136, which are angularly spaced 120 degrees apart from one another, cooperate with the lowermost edge 94 (typically adjacent the tabs 90) of the actuator button 60 and the cutouts 92. When an upper surface of each tab 136 contacts the lowermost edge 94 of the actuator button 60 (FIG. 7), then the actuator button is precluded from moving axially with respect to the container 12 and as such is "locked." When the locking ring 64 is rotated (desirably less than about 90 degrees) with respect to the intermediate ring 62, the actuator button 60 and the container 12, the tabs 136 can align with the cutouts 92 in the button 60 to allow the button to move axially with respect to the container thus opening the valve assembly 22, whereby the tabs 136 reside in the cutouts 92 as the button 60 is pressed downwardly.

In the depicted embodiment, the locking ring 64 does not translate or move along its rotational axis. The upper edge of the locking ring 64 remains below the outlet 100 for the dispenser when the locking ring is in both the locked and the unlocked position. Alternative embodiments may allow for translational movement along the rotational axis.

Annular ridges 138 can be provided on an outer surface of the locking ring 64 to facilitate gripping and rotation of the locking ring. Smooth surfaces 142 can also be provided on the locking ring 64 interposed between the vertical ridges as an alignment feature to indicate whether the dispenser is in a "locked" or an "unlocked" position. The smooth surfaces 142 can align with the longitudinal recesses 104 in the actuator button 60 to indicate a "locked" or "unlocked" position.

The tabs 136 also cooperate with the intermediate ring 62 to limit the angular rotational displacement of the locking ring 64 with respect to the intermediate ring. With reference back to FIGS. 9 and 10, the intermediate ring 62 includes wings 140 extending outwardly from a cylindrical smooth wall 142. The wings 140 are disposed on a lower half of the upper section 110 and a smooth cylindrical wall 142 is provided on the upper half. The wings 140 provide a first contact surface 144 against which the tabs 136 (FIG. 13) on the locking ring contact when the locking ring is rotated with respect to the intermediate ring. A second contact surface 146 that is angularly spaced from the first contact surface is also found on the upper section 110 of the intermediate ring. The tabs 136 (FIG. 13) of the locking ring 64 move between the contact surfaces 144 and 146. When the tabs 136 contact the contact surface 144, the dispenser is in the "locked" position. When the tabs 136 contact the second contact surface 146, the dispenser is in the "unlocked" position.

With reference to FIG. 9, bumps 150 and 152 are disposed between a set of contact surfaces 144 and 146. The bumps 150 and 152 cooperate with the tabs 136 and the locking ring to provide an indexing and/or locking feature to allow the user of the dispenser to know the state, e.g. locked or unlocked, in which the dispenser is disposed. The tabs 136 ride over the bumps 150 and 152 to provide an interference or snap fit.

A liquid cosmetic product dispenser has been described with reference to certain embodiments. The liquid cosmetic product dispenser can dispense all sorts of liquid cosmetic products, including, hair spray, body spray, antiperspirant, deodorant, perfume, cologne, as well as other products that are typically dispensed via an aerosol can. Many available alterations may occur to those skilled in the art upon reading the preceding detailed description. The invention is not intended to be limited solely to those embodiments described above, but is intended to include any device that comes within the scope of the appended claims.

The invention claimed is:

1. A dispensing assembly, comprising:

a dispenser having a central axis and an internal free volume of less than about 60 mL; and a liquid cosmetic product disposed in the dispenser under pressure that is greater than atmospheric pressure, the dispenser includes a movable actuator button to control dispensing of the product, an intermediate ring that is concentrically located relative to the central axis that inhibits rotational movement of the actuator button, the intermediate ring has a first diameter and is substantially prevented from axial and rotational movement relative to the actuator button, and a locking ring to selectively lock the actuator button, the locking ring is located concentric to the central axis and has a diameter greater than the first diameter, wherein the locking ring and the intermediate ring are connected to preclude axial movement in relation to one another while allowing rotational movement of the locking ring about the central axis with respect to the intermediate ring, the locking ring includes a generally cylindrical outer surface configured to be gripped by an operator of the assembly for rotating the locking ring about the central axis of the dispenser upon application of a torque, which is less than the torque required to rotate the intermediate ring about the container, the locking ring being fixed to selectively inhibit translational movement of the actuator button when the locking ring is rotated with respect to the intermediate ring.

2. The assembly of claim 1, wherein the dispenser includes an exposed fragrance outlet that allows an operator of the assembly to dispense fragrance from the dispenser without having to remove a cap.

3. The assembly of claim 1, further comprises a valve assembly for selectively dispensing product, the valve assembly including a valve cup including an opening and a valve stem disposed in the opening, the valve stem including a protuberance and the actuator button including a passage that receives the valve stem and wherein at least one of the protuberance and an inner surface of the passage deforms to connect the actuator button to the valve stem.

4. The assembly of claim 1, wherein the dispenser has a diameter less than about 2 cm and a height less than about 8.5 cm.

5. The assembly of claim 1, wherein the dispenser is configured to be at least partially concealed in a closed fist of a hand having a palm breadth of between about 7 cm to about 9 cm and a first finger length of about 10 cm to about 14 cm.

6. The assembly of claim 1, further including:

a plurality of tracks formed in the intermediate ring, the tracks are angularly spaced 120 degrees apart from one another;

a stem socket that is radially spaced from an outer wall of the actuator button;

a plurality of splines that extend from the stem socket to provide the stem socket with a non-circular configuration to control the rotational movement of the actuator button with respect to the intermediate ring; and a plurality of ramps, equal to the number of tracks, which are formed on an inner wall of the intermediate ring and are sloped toward the tracks to accommodate the plurality of splines of the actuator button, wherein the ramps provide an alignment feature for the insertion of the actuator button into the intermediate ring during assembly of the dispensers.

7. The assembly of claim 1, wherein the dispenser further comprises a container and a valve assembly for selectively opening and closing the container, the valve assembly including a valve cup connected to the container and including an opening and a valve stem disposed in the opening, the locking ring being moveable between a locked position and an unlocked position, when in the unlocked position the actuator button being moveable to an operating position to move the valve stem to open the valve assembly.

8. The assembly of claim 7, wherein the valve stem includes an annular protrusion and the actuator button includes a passage that receives the valve stem, a diameter of the passage being smaller than a diameter of the valve stem at the annular protrusion.

9. The assembly of claim 7, wherein the valve cup has a diameter less than about 25 cm.

10. The assembly of claim 9, wherein the valve cup has a diameter less than about 20 cm.

11. The assembly of claim 7, wherein the valve cup is externally crimped to the container.

12. The assembly of claim 11, wherein the container and the valve cup measure a diameter between about 11.2 mm and about 11.7 mm where the valve cup is crimped to the container.

13. The assembly of claim 11, wherein an indentation having a depth of about 4.4 mm to about 5.3 mm is formed where the valve cup is crimped to the container.

14. The assembly of claim 7, wherein the actuator button, the valve assembly and the locking ring are a single unit that is disposed or recycled when the liquid cosmetic product has been dispensed from the dispenser.

15. The assembly of claim 1, wherein the internal free volume of the dispenser is between about 5 mL and about 40 mL.

16. The assembly of claim 15, wherein the internal free volume of the dispenser is between about 6 mL and about 10 mL.

17. The assembly of claim 16, wherein the dispenser has a diameter between about 1.2 cm and about 1.8 cm and a height between about 7 cm and about 8 cm.

18. A capless aerosol dispenser comprising:

a rigid container defining a chamber and an outlet in communication with the chamber, the container being less than about 9 cm in height and less than about 3.5 cm in diameter;

a liquid cosmetic product in the container, the product being under pressure exceeding atmospheric pressure;

a valve assembly connected to the container for selectively opening and closing a passage in communication with the outlet to allow for the selective discharge of the product from the container, the valve assembly including a valve cup that includes an opening and a valve stem disposed in the opening, the valve stem being moveable between an open position, which allows the product to exit the chamber, and a closed position, which precludes the product from exiting the chamber;

an actuator connected to the valve stem, the actuator being selectively moveable along a first axis between a first position, which moves the valve stem into the open position, and a second position, which allows the valve stem to move into the closed position, the actuator further including an outlet opening in communication with the passage, the outlet opening being uncovered no matter the location of other components of the device;

an external locking ring surrounding at least a portion of an outer surface of the container disposed below the valve cup, the locking ring being moveable between an unlocked position, which allows the actuator to move linearly along the first axis, and a locked position, which precludes the actuator from moving linearly along the first axis;

and an intermediate ring connected to the container, wherein the locking ring is connected to the intermediate ring in a manner to allow rotational movement of the locking ring with respect to the intermediate ring.

19. The dispenser of claim 18, wherein an upper edge of the locking ring is disposed below the outlet opening in the unlocked position and the locked position.

20. The dispenser of claim 18, wherein the dispenser is configured to be at least partially concealed in a closed fist of a hand having a palm breadth of between about 7 cm to about 9 cm and a first finger length of about 10 cm to about 14 cm.

21. The dispenser of claim 18, wherein a torque required to rotate the intermediate ring with respect to the container is at least twice as much as a torque required to rotate the locking ring with respect to the intermediate ring.

22. The dispenser of claim 18, wherein the diameter of the container is less than about 2 cm.

* * * * *